US007748998B2

(12) United States Patent
Fogg

(10) Patent No.: US 7,748,998 B2
(45) Date of Patent: Jul. 6, 2010

(54) ELECTRICAL CONNECTOR WITH MATCHED COUPLING

(75) Inventor: Michael Warren Fogg, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/212,209

(22) Filed: Sep. 17, 2008

(65) Prior Publication Data

US 2010/0068902 A1 Mar. 18, 2010

(51) Int. Cl.
*H01R 12/00* (2006.01)

(52) U.S. Cl. ..... 439/79

(58) Field of Classification Search ..... 439/79, 439/540.1, 701

See application file for complete search history.

(56) References Cited

U.S. PATENT DOCUMENTS

| | | | |
|---|---|---|---|
| 6,280,209 | B1 | 8/2001 | Bassler et al. |
| 6,350,134 | B1 | 2/2002 | Fogg et al. |
| 6,540,559 | B1 | 4/2003 | Kemmick et al. |
| 7,165,981 | B2 | 1/2007 | Bassler et al. |

*Primary Examiner*—Khiem Nguyen

(57) ABSTRACT

An electrical connector includes a housing having a mating end and a mounting end. The electrical connector also includes a plurality of contact modules each having a web with opposed contact faces and flanges extending from ends of the web. Each contact module holds a pair of signal contacts with the signal contacts being arranged along the contact faces. The flanges and the web forming channels that expose the contact faces and signal contacts. The electrical connector includes a plurality of ground contacts each being coupled to at least one of the housing and a corresponding contact module. Each ground contact being arranged along one of the flanges of the corresponding contact module.

20 Claims, 5 Drawing Sheets

ELECTRICAL CONNECTOR WITH MATCHED COUPLING

BACKGROUND OF THE INVENTION

The subject matter herein relates generally to electrical connectors having matched coupling, and more particularly, to electrical connectors having ground contacts arranged along a perpendicular bisector of corresponding signal contacts.

Modular connectors are in wide use in electronic systems, such as computer systems. The modular connectors are used to connect various components within the systems, such as peripheral devices or networks, with the computers. Typically, the modular connectors represent either a plug assembly or a header assembly which are mated in order to provide an electrical connection between components of the system.

The modular connectors typically include a plurality of signal contacts and ground contacts. The signal and ground contacts are arranged in rows and/or columns. The signal contacts are typically arranged in pairs and, along with a corresponding ground contact, form a contact set that, transmits a differential signal. However, electrical interference and cross talk occur between the signal contacts of adjacent contact sets. Because, the signal contacts are arranged in rows and/or columns in-line with each other, two adjacent signal contacts may electrically interfere and produce cross-talk with each other. The electrical interference and cross-talk among signal contacts reduces the speed and operating efficiency of the system. Modular connectors also suffer from decreased performance due to impedance discontinuities. For example, discontinuities in differential and/or common mode impedance may exist. Problems with electrical interference, cross-talk and/or impedance discontinuity are exaggerated as the density of the modular connectors is increased, as the size of the modular connectors is decreased, and/or as the data rates are increased.

Moreover, conventional modular connectors experience certain difficulties during manufacturing. For example, due to the increased density and/or decreased size of the modular connectors, manufacturing the modular connectors may be difficult and time consuming.

Thus a need exists for modular connectors that may be manufactured in a cost-effective and reliable manner. A need exists for modular connectors that have increased signal throughput. A need exists for modular connectors that have a reduction in noise.

BRIEF DESCRIPTION OF THE INVENTION

In one embodiment, an electrical connector is provided including a housing having a mating end and a mounting end. The electrical connector also includes a plurality of contact modules each having a web with opposed contact faces and flanges extending from ends of the web. Each contact module holds a pair of signal contacts with the signal contacts being arranged along the contact faces. The flanges and the web forming channels that expose the contact faces and signal contacts. The electrical connector includes a plurality of ground contacts each being coupled to at least one of the housing and a corresponding contact module. Each ground contact being arranged along one of the flanges of the corresponding contact module.

Optionally, the ground contact may be arranged on the flange such that the center of the ground contact is positioned along a perpendicular bisector between signal contacts. The signal contacts may be aligned with one another across the web and arranged equidistant from the ground contact. The contact module may have an I-shape. Optionally, the channels may be open to air between the flanges. The contact modules may be positioned within the housing such that channels of adjacent contact modules are open to one another to form a chamber with signal contacts of different contact modules exposed within each chamber. The signal contacts may be arranged along a contact axis, where adjacent contacts are separated along the contact axis by different dielectrics. The dielectric separating adjacent contacts within the pair may have a first dielectric constant, and the dielectric separating contacts of different pairs may have a second dielectric constant different from the first dielectric constant. Optionally, adjacent contact modules are arranged such that the ground contacts are oriented in an alternating inverted sequence.

In an other embodiment, an electrical connector is provided that includes a housing which holds signal and ground contacts arranged as contact sets. Each contact set includes a pair of adjacent signal contacts and a ground contact, and the pair of signal contacts within the contact set carrying differential signals. Each of the signal contacts and ground contacts include a mating end, a mounting end, and an intermediate section therebetween, wherein the ground contact of the contact set is centered on a perpendicular bisector between the corresponding pair of signal contacts. The contact sets are arranged in an alternating inverted sequence with ground contacts of adjacent contact sets aligned with one another along a majority of the intermediate sections thereof.

DETAILED DESCRIPTION OF THE INVENTION

Figure 1:
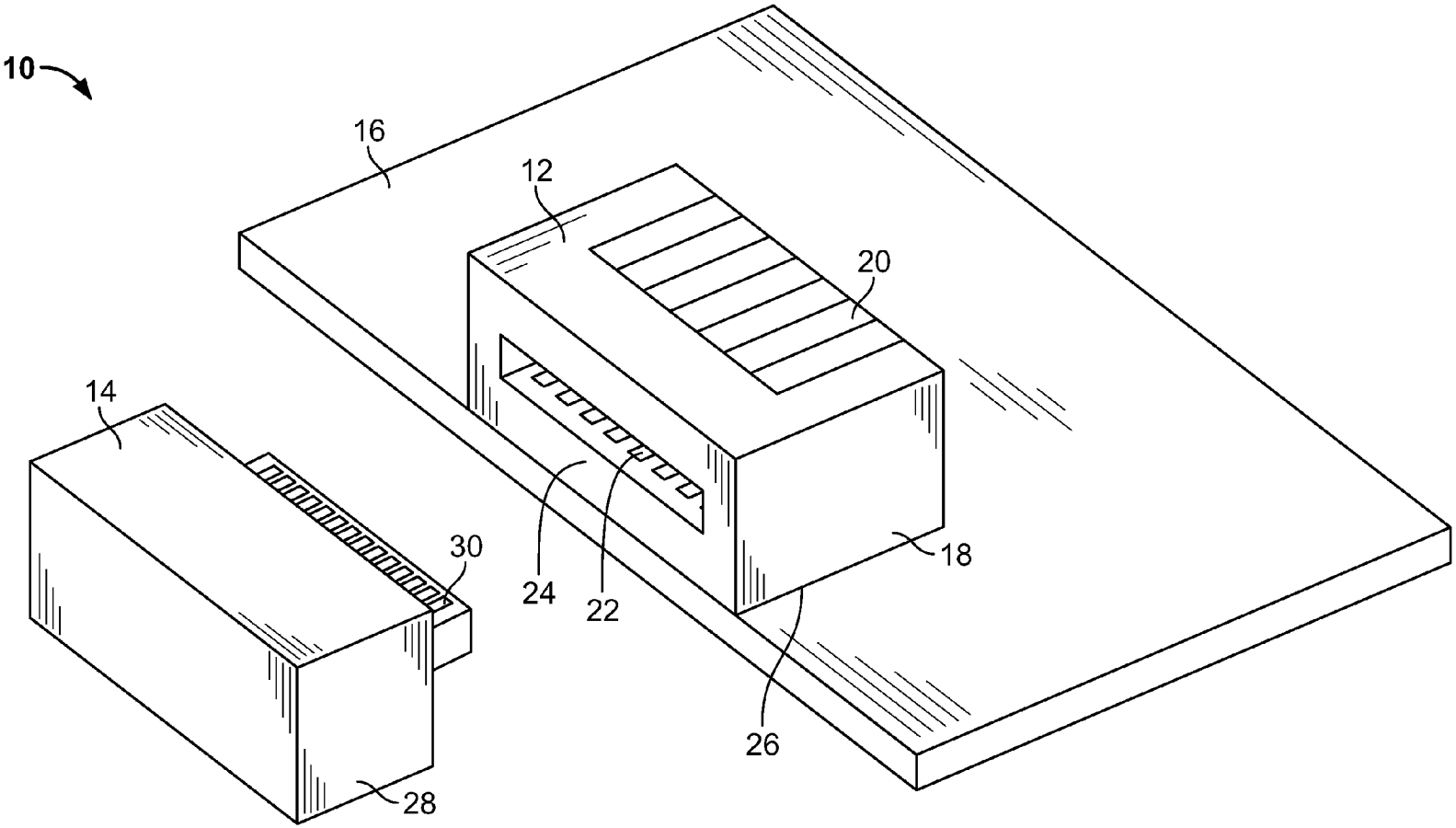
FIG. 1 illustrates a pair of electrical connectors for an electronic system that are formed in accordance with an exemplary embodiment.

FIG. 1 is a cross-sectional view of electrical connectors of an electronic system 10 that are formed in accordance with an exemplary embodiment. The electrical connectors are modular connectors used to connect various components within the electronic system 10. The electrical connectors represent a header or receptacle connector 12 and a plug connector 14. In the illustrated embodiment, the connector 12 is board mounted to a circuit board 16, which may be part of an electronic device, such as a computer. The plug connector 14 may be mated with the connector 12 to form an electrical connection therebetween. The plug connector 14 may be board mounted or cable mounted to interconnect another device with the computer.

The connector 12 includes a housing 18 holding a plurality of contact modules 20. Each contact module 20 includes a plurality of contacts 22. The contacts 22 are terminated to the circuit board 16 to create a circuit therebetween. The housing 18 includes a mating end 24 having a mating interface configured to mate with the plug connector 14. The housing 18 includes a mounting end 26 mounted to the circuit board 16. The plug connector 14 includes a housing 28 and a plurality of mating contacts 30 configured to mate with the contacts 22 to create an electrical connection therebetween.

The connector 12 and plug connector 14 are illustrated schematically as representing two modular connectors that send and/or receive electronic signals therebetween. The modular connectors 12, 14 shown in FIG. 1 are merely illustrative representations of connectors, and the subject matter herein may be applied to a variety of different types of electrical connectors in a variety of different applications. The modular connectors 12, 14 may have any size and/or shape depending on the particular application. The modular connectors 12, 14 may have any number of contacts 22, 30 arranged in any configuration for transmitting the electronic signals.

Figure 2:
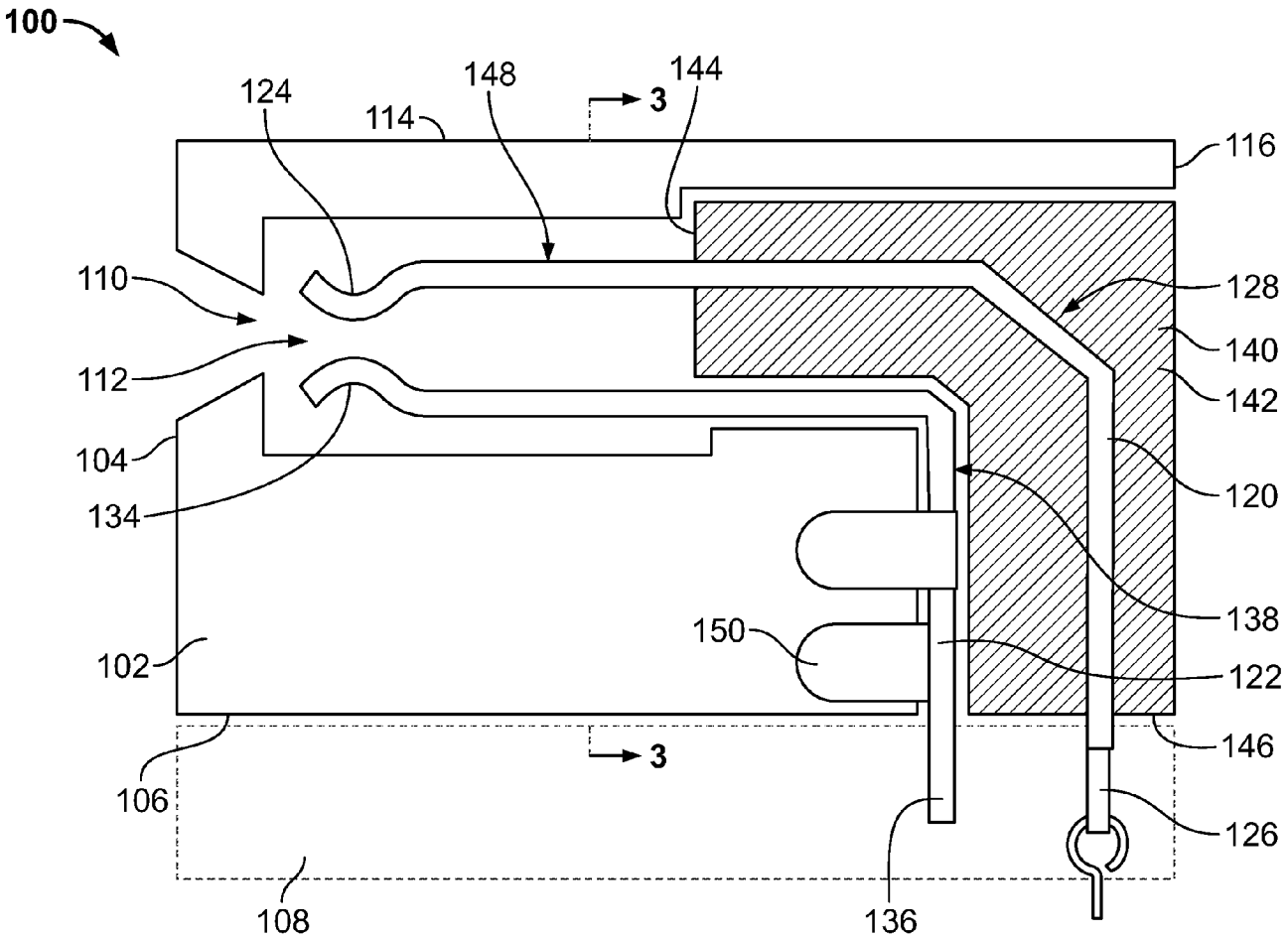
FIG. 2 is a cross-sectional view of an electrical connector for use with the electronic system shown in FIG. 1.

FIG. 2 is a cross-sectional view of an electrical connector 100 for use with the electronic system 10 (shown in FIG. 1). The electrical connector 100 represents a header or receptacle connector similar to the electrical connector 12 illustrated in FIG. 1. The subject matter and features of the electrical connector 100 described herein may be equally applicable to a plug type of connector, such as the plug connector 14 illustrated in FIG. 1.

The electrical connector 100 includes a housing 102 having a mating end 104 and a mounting end 106. The mounting end 106 is mounted to a circuit board 108. The mating end 104 includes an opening 110 opening to a mating cavity 112. The plug connector (not shown) is configured to be loaded through the opening 110 into the mating cavity 112. The housing 102 includes a top 114 generally opposed to the mounting end 106. The housing 102 includes a rear 116 generally opposed to the mating end 104.

The electrical connector 110 includes a plurality of signal contacts 120 and a plurality of ground contacts 122, one of each being illustrated in FIG. 2. The signal contacts 120 include a mating end 124, a mounting end 126 and an intermediate section 128 therebetween. In the illustrated embodiment, the signal contacts 120 are right angle contacts having the mating and mounting ends 124, 126 oriented generally perpendicular to one another. Alternative, non-right angle configurations are possible in alternative embodiments. The mating end 124 is configured to be electrically connected to a corresponding signal contact of the plug connector. The mounting end 126 is terminated to the circuit board 108. In the illustrated embodiment, a compliant pin is provided at the mounting end 126 for terminating to a through hole in the circuit board 108. Other termination means or processes may be used in alternative embodiments, such as surface mounting to the top of the circuit board.

The ground contacts 122 include a mating end 134, a mounting end 136 and an intermediate section 138 therebetween. In the illustrated embodiment, the ground contacts 122 are right angle contacts having the mating and mounting ends 134, 136 oriented generally perpendicular to one another. Alternative, non-right angle configurations are possible in alternative embodiments. The mating end 134 is configured to be electrically connected to a corresponding ground contact, or other grounded portion, of the plug connector. The mounting end 136 is terminated to the circuit board 108. In the illustrated embodiment, a compliant pin is provided at the mounting end 136 for terminating to a through hole in the circuit board 108. Other termination means or processes may be used in alternative embodiments, such as surface mounting to the top of the circuit board.

In an exemplary embodiment, the electrical connector 100 includes a plurality of contact modules 140, one of which is illustrated in cross-section in FIG. 2. The contact module 140 holds at least one of the signal contacts 120. Optionally, the contact module 140 may additionally hold at least one of the ground contacts 122. The contact module 140 includes a dielectric body 142 fabricated from a dielectric material, such as a plastic material. The dielectric material has a dielectric constant, and the type of material may be selected based on the dielectric constant. The signal contacts 120 are routed along the dielectric body 142. Optionally, the signal contacts 120 may be routed along an external surface of the dielectric body 142. Alternatively, the signal contacts 120 may be embedded within the dielectric body 142, such as by overmolding the dielectric body 142 around at least a portion of the signal contacts 120.

The contact modules 140 are held within, or otherwise secured to, the housing 102. In an exemplary embodiment, the contact modules 140 are loaded into the housing 102 through the rear 116 of the housing 102. The contact module 140 includes a mating end 144 and a mounting end 146 oriented generally perpendicular to the mating end 144. A portion of the intermediate section 128 of the signal contact 120, referred to hereinafter as a mating section 148, extends from the mating end 144 into the mating cavity 112 for mating with the plug connector. A portion of the signal contact 120 extends from the mounting end 146 for terminating to the circuit board 108.

In the illustrated embodiment, the ground contact 122 includes a plurality of tabs 150 that extend from the intermediate section 138. The tabs 150 extend into the housing 102 to couple the ground contact 122 to the housing 102. The contact module 140 is loaded into the housing 102 such that the ground contact, 122 is captured between the housing 102 and the contact module 140. Optionally, the ground contact 122 may engage an outer surface of the contact module 140 when the contact module 140 is loaded into the housing 102. In an alternative embodiment, rather than coupling to the housing 102, the ground contact 122 may be coupled to the contact module 140. For example, the tabs 150 may be secured to the contact module 140. The ground contact 122 may be loaded into the housing 102 with the contact module 140.

Figure 3:
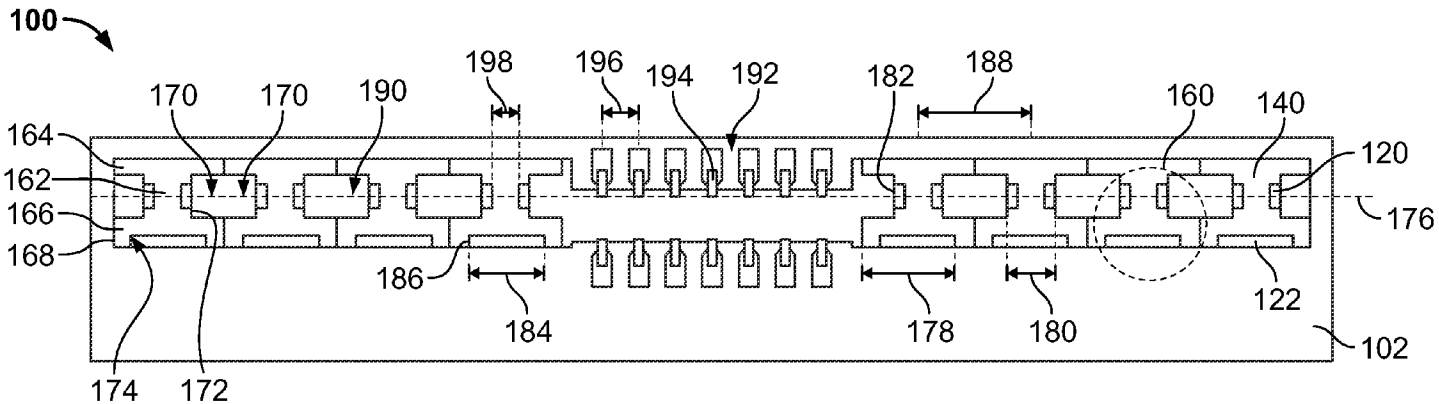
FIG. 3 is another cross-sectional view of the electrical connector shown in FIG. 2.

FIG. 3 is another cross-sectional view of the electrical connector 100 taken along line 3-3 shown in FIG. 2. The contact modules 140 are illustrated within the housing 102. The signal contacts 120 and ground contacts 122 are also illustrated within the housing 102. In an exemplary embodiment, the signal and ground contacts 120, 122 are arranged as contact sets 160. Each contact set 160 includes a pair of signal contacts 120 and one ground contact 122. The signal contacts 120 within each contact set 160 carry differential signals. Each contact module 140 is associated with a single contact set 160.

In an exemplary embodiment, the contact module 140 has a generally I-shaped cross section including a web 162 and first and second flanges 164, 166 at ends of the web 162. The flanges 164, 166 define sides 168 of the contact module 140. In the illustrated embodiment, the contact modules 140 are arranged within the housing 102 such that the sides 168 abut adjacent contact modules 140. The flanges 164, 166 and the web 162 form channels 170 in the sides 168 that extend inward to contact faces 172 of the web 162. The signal contacts 120 are arranged along respective contact faces 172 of the web 162. Optionally, the signal contacts 120 may be substantially centered along the web 162 between the flanges 164, 166. The channels 170 expose the signal contacts 120 to air or another dielectric material that fills the channels 170. The air or dielectric material filling the channel 170 has a dielectric constant that is different than the dielectric constant of the contact module 140.

In an exemplary embodiment, the second flange 166 is sized larger than the first flange 164 and includes a slot 174 on an outer surface thereof. The slot 174 is sized and shaped to receive at least a portion of the ground contact 122. Optionally, the ground contact 122 may be substantially centered on the web 162. In an exemplary embodiment, the ground contact 122 is centered along the perpendicular bisector between the signal contacts 120 of the contact set 160. The signal contacts 120 are thus positioned equidistant from the ground contact 122 and are electrically symmetrical with respect to the ground contact 122. In this manner, the electrical performance of the electrical connector 100 may be enhanced. For example, common mode and differential mode impedances may be maintained between the mating ends 124 and mounting ends 126 (shown in FIG. 2) and/or between the circuit board. As such, mode conversions and reflections may be minimized and/or ground return currents may be effectively canceled to reduce noise and/or cross-talk. Optionally, the design of the signal contacts 120 and the ground contact 122 may be selected to match the impedance of the board design to reduce the common mode impedance. As such, the amount of common mode energy reflection, due to skew and/or asymmetrical signals, may be reduced. Electromagnetic interference and/or loss of signal quality may also be reduced by matching the common mode impedance of the connector and the circuit board.

In the illustrated embodiment, the contact modules 140 are positioned within the housing 102 such that the signal contacts 120 of each contact module 140 are aligned with one another in a row along a contact axis 176. The flanges 164, 166 have a width 178 along the contact axis 176 between the sides 168. The web 162 has a width 180 along the contact axis 176 that is less than the width 178 of the flanges 164, 166. The signal contacts 120 are arranged along the contact faces 172 such that outer surfaces 182 of the signal contacts 120 are substantially flush with the contact faces 172. The outer surfaces 182 are thus separated by a distance substantially equal to the width 180. In alternative embodiments, the signal contacts 120 may be oriented differently, such that the distance separating the outer surfaces 182 is greater than or less than the width 180. Each ground contact 122 has a width 184 along the contact axis 176 defined between opposed side edges 186 of the ground contact 122. In an exemplary embodiment, the width 184 of the ground contact 122 is greater than the distance separating the outer surfaces 182 of the signal contacts 120. As such, the side edges 186 are positioned beyond the outer surfaces 182 of the signal contacts 120. The ground contacts 122 thus discourage intra-pair coupling between signal contacts 120 of different contact sets 160. The centerlines of the contact modules 140 and/or the ground contacts 122 may be spaced apart by a distance 188.

The contact modules 140 are positioned within the housing 102 such that channels 170 of adjacent contact modules 140 are open to one another to form a closed chamber 190. The chamber 190 is closed by the flanges 164, 166 and webs 162 of the adjacent contact modules 140. Signal contacts 120 of different contact modules 140 are both exposed within the chamber 190. Each of the signal contacts 120 are separated from an adjacent signal contact 120 by a dielectric. For example, the signal contacts 120 within each contact set 160 are separated by the dielectric material of the web 162, which has a certain dielectric constant. The signal contacts 120 of adjacent contact sets 160 that are both exposed within the chamber 190 are separated by air, which has a different dielectric constant than the dielectric material of the web 162. Optionally, the chamber 190 may be filled with a dielectric material or substance having a different dielectric constant than air. The materials separating adjacent signal contacts 120 may be selected based on the dielectric constant to control electrical characteristics and interactions between the adjacent signal contacts 120, such as, for example, to reduce coupling between signal contacts 120 of different contact sets 160, which may reduce cross-talk therebetween.

In an exemplary embodiment, the electrical connector 100 includes a secondary mating area 192 having secondary contacts 194, as compared to the primary mating area defined by the contact modules 140 and signal contacts 120. Optionally, the secondary mating area 192 may be substantially centered within the housing 102 with primary mating areas on both sides of the secondary mating area 192. The secondary mating area 192 includes a different mating interface and may include a different style of contact for mating with the plug connector. In one embodiment, the secondary mating interface may be an SFP-type mating interface. The secondary mating area 192 may be used to transmit different types of signals and/or data. The secondary mating area 192 may be used to transmit signals and/or data at a different speed. The secondary contacts 194 may be either signal contacts or ground contacts, depending on the particular application. The secondary contacts 194 are arranged in two rows, but other configurations are possible in alternative embodiments. The secondary contacts 194 have a spacing 196 which may be different than a spacing 198 of the signal contacts 120.

Figure 4:
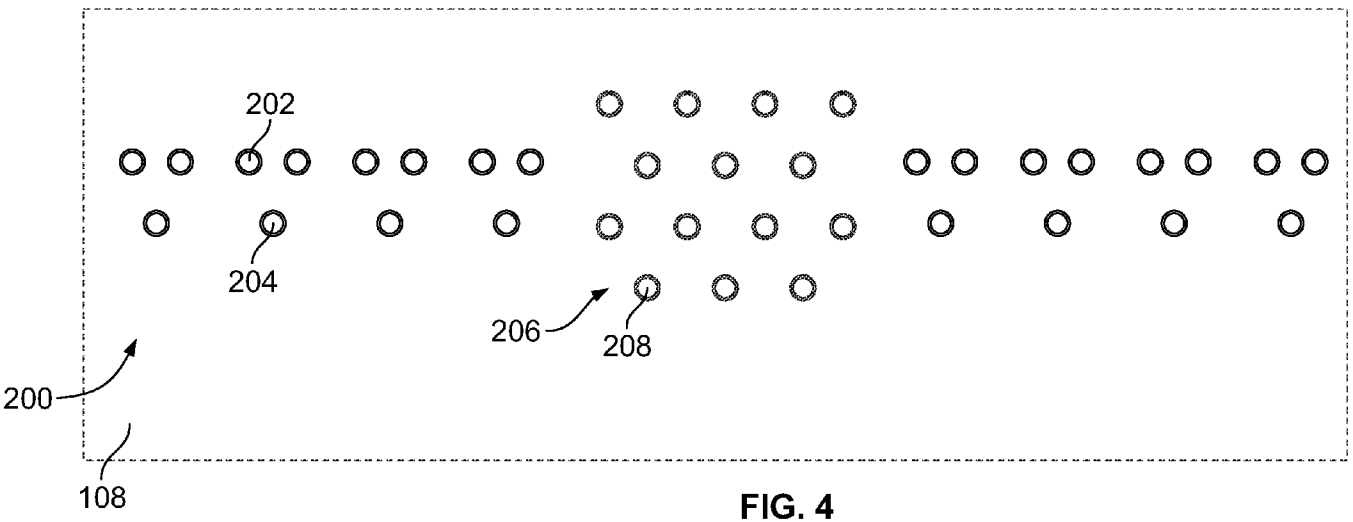
FIG. 4 illustrates a mating interface of a circuit board for the electrical connector shown in FIG. 2.

FIG. 4 illustrates a mating interface 200 of the circuit board 108 for the electrical connector 100 (shown in FIG. 2). The mating interface 200 includes a plurality of signal vias 202 for the signal contacts 120 (shown in FIG. 2) and a plurality of ground vias 204 for the ground contacts 122 (shown in FIG. 2). The ground vias 204 are positioned along a perpendicular bisector between the signal vias 202 and is thus positioned equidistant from each of the signal vias 202. The signal vias 202 are each aligned in a row and the ground vias 204 are each aligned in a different row.

The mating interface 200 includes a secondary mating area 206 having a plurality of vias 208 for receiving the secondary contacts 194 (shown in FIG. 3). The vias 208 are arranged in four rows with the vias 208 in adjacent rows being staggered or offset to allow for denser spacing.

Figure 5:
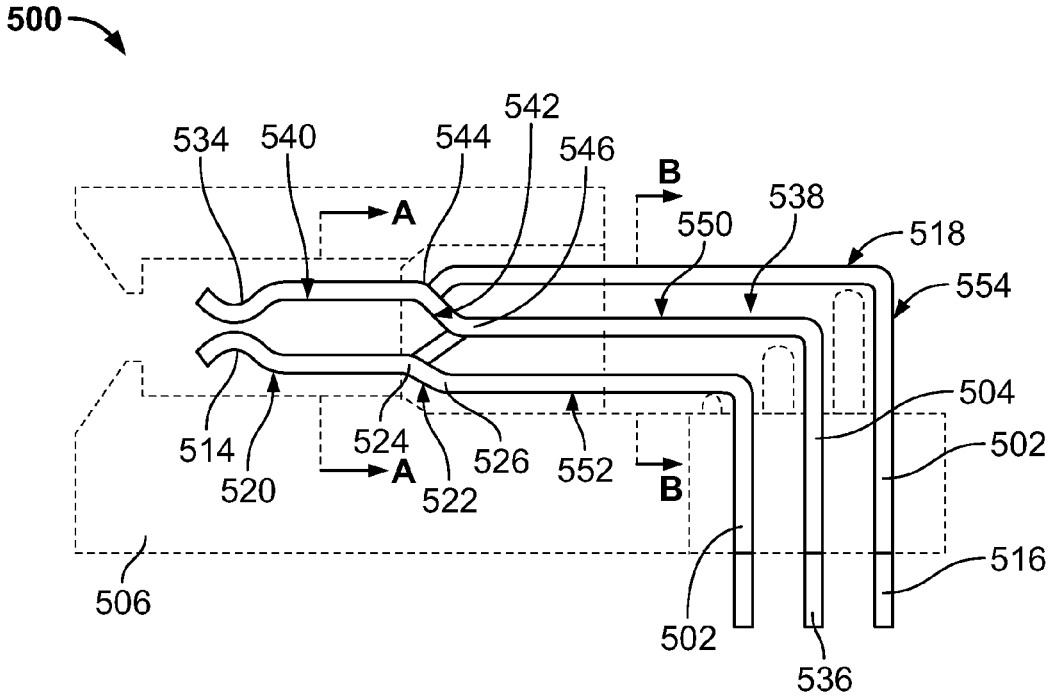
FIG. 5 is a cross-sectional view of an alternative electrical connector having contacts held by a housing.

FIG. 5 is a cross-sectional view of an alternative electrical connector 500 having signal and ground contacts 502, 504 held by a housing 506 (shown in phantom). In contrast to the embodiment described above, the signal and ground contacts 502, 504 are held by the housing 506 rather than a contact module.

The signal contacts 502 include a mating end 514, a mounting end 516 and an intermediate section 518 therebetween. In the illustrated embodiment, the signal contacts 502 are right angle contacts having the mating and mounting ends 514, 516 oriented generally perpendicular to one another. The mating end 514 is configured to be electrically connected to a corresponding signal contact of the plug connector. The mounting end 516 is configured to be terminated to a circuit board.

The intermediate section 518 includes a mating section 520 and a transition section 522. The mating section 520 is generally planar and is provided proximate the mating end 514. The transition section 522 is provided between the mating section 520 and the mounting end 516. The transition section 522 is configured to transition the intermediate section 518 from one plane to a different plane. The different planes may be parallel to one another. For example, the transition section 522 may transition the intermediate section 518 generally toward the circuit board or alternatively, may transition the intermediate section 518 generally away from the circuit board. In the illustrated embodiment, the transition section 522 includes a first bend 524 provided at the intersection of the transition section 522 with the mating section 520, and a second bend 526. The transition section 522 may be angled between the first and second bends 524, 526. Optionally, the bends 524, 526 may be in different directions.

The ground contacts 504 include a mating end 534, a mounting end 536 and an intermediate section 538 therebetween. In the illustrated embodiment, the ground contacts 504 are right angle contacts having the mating and mounting ends 534, 536 oriented generally perpendicular to one another. The mating end 534 is configured to be electrically connected to a corresponding ground contact, or other grounded portion, of the plug connector. The mounting end 536 is terminated to the circuit board.

The intermediate section 538 includes a mating section 540 and a transition section 542. The mating section 540 is generally planar and is provided proximate the mating end 534. The transition section 542 is provided between the mating section 540 and the mounting end 536. The transition section 542 is configured to transition the intermediate section 538 from one plane to a different plane. The different planes may be parallel to one another. For example, the transition section 542 may transition the intermediate section 538 generally toward the circuit board or alternatively, may transition the intermediate section 538 generally away from the circuit board. In the illustrated embodiment, the transition section 542 includes a first bend 544 provided at the intersection of the transition section 542 with the mating section 540, and a second bend 546. The transition section 542 may be angled between the first and second bends 544, 546. Optionally, the bends 544, 546 may be in different directions.

In an exemplary embodiment, the signal and ground contacts 502, 504 of the electrical connector 500 are aligned in rows. The mating sections 520, 540 are arranged in two rows and the remaining portions of the intermediate sections 518, 538 are arranged in three rows. The transition sections 522, 542 are configured to transition the signal and ground contacts 502, 504 from two rows to three rows. In an exemplary embodiment, the signal and ground contacts 502, 504 are oriented such that each of the ground contacts 504 are provided only in a middle 550 of the three rows. The signal contacts 502 are oriented in either the inner row 552 or the outer row 554. Other configurations are possible in alternative embodiments, such as configurations that include more or less than three rows or signal or ground contacts 502, 504 in different ones of the rows 550-554.

Figure 6:
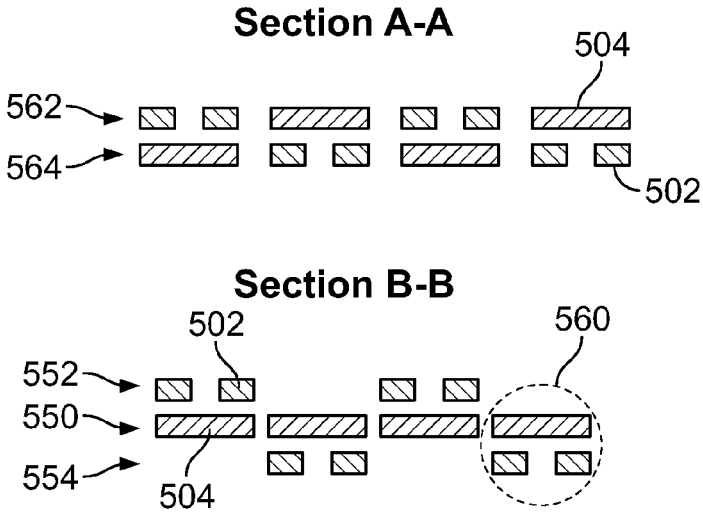
FIG. 6 illustrates cross-sectional views of the contacts shown in FIG. 5 taken along different portions of the contacts.

FIG. 6 illustrates cross-sectional views of the signal and ground contacts 502, 504 taken along different portions of the contacts, namely taken along line A-A through the mating sections 520, 540 and line B-B through another portion of the intermediate section 518, 538 downstream of the transition sections 522, 542. As illustrated in FIG. 6, the contacts 502, 504 are arranged in contact sets 560. Each contact set 560 includes a pair of signal contacts 502 and one ground contact 504. The signal contacts 502 within each contact set 560 carry differential signals. In an exemplary embodiment, the ground contact 504 is centered along the perpendicular bisector between the signal contacts 502 of the contact set 560. The signal contacts 502 are thus positioned equidistant from the ground contact 504.

The cross-section taken along line A-A through the mating sections 520, 540 indicate that the contacts 502, 504 are arranged in a first, or upper row 562 and a second, or lower row 564. The contact sets 560 are configured such that the contacts 502, 504 are in an alternating inverted sequence. For example, the ground contact 504 in one contact set 560 is in a bottom position with respect to the signal contacts 502 while the ground contacts 504 of the adjacent contact sets 560 are in a top position with respect to the signal contacts 502. As such, within the upper row 562, the signal contacts 502 of one contact set 560 are flanked by ground contacts 504 of adjacent contact sets 560. Similarly, within the lower row 564, the signal contacts 502 of one contact set 560 are flanked by ground contacts 504 of adjacent contact sets 560. Such an arrangement may reduce cross-talk between signal contacts 502 of adjacent contact sets 560.

The cross-section taken along line B-B through the intermediate sections 518, 538 downstream of the transition sections 522, 524 indicate that the contacts 502, 504 are arranged in three rows, namely the inner row 552, the middle row 550 and the outer row 554. Each of the ground contacts 504 are provided in the middle row 550. The signal contacts 502 are provided in one of the other rows 552, 554. In an exemplary embodiment, both signal contacts 502 of the contact sets 560 are provided in the same row. The signal contacts 502 of adjacent contact sets 560 are arranged on opposite sides of the respective ground contacts 504, which maximizes the separation distance between signal contacts 502 of adjacent contact sets 560.

With reference back to FIG. 5, the ground contacts 504 are substantially aligned with one another along a majority of the intermediate sections 538 thereof. For example, each of the ground contacts 504 are provided in the middle row 550 and substantially aligned with one another from the mounting end 536 to the transition section 542. In an exemplary embodiment, the signal and ground contacts 502, 504 within a contact set 560 are each transitioned by the transition section 522, 542 in the same direction. Additionally, adjacent contact sets 560 are transitioned in opposite directions.

Figure 7:
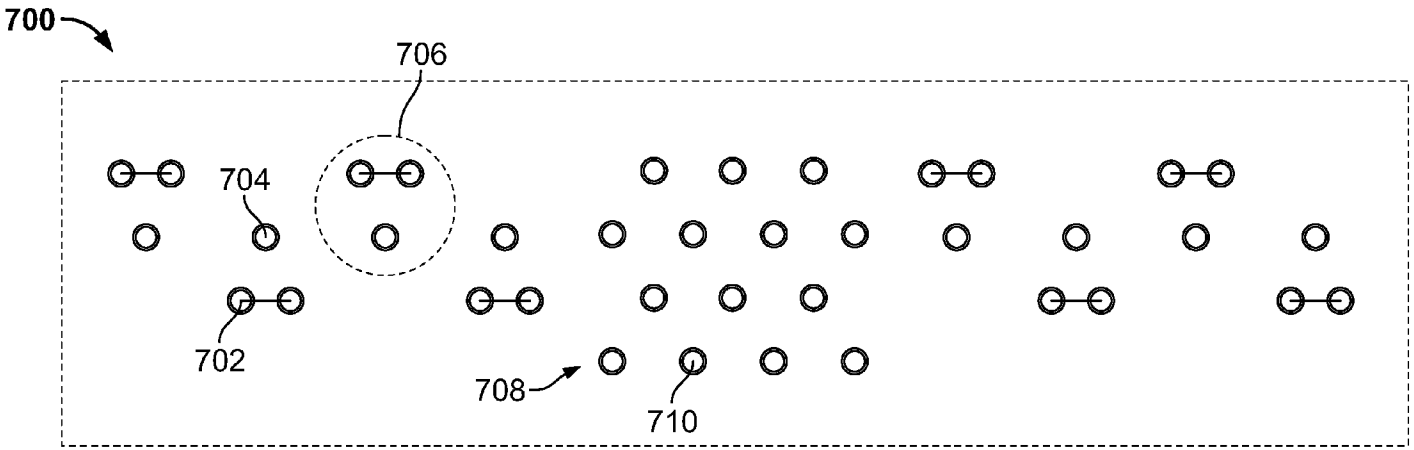
FIG. 7 illustrates a mating interface of a circuit board for the electrical connector shown in FIG. 5.

FIG. 7 illustrates a mating interface 700 of a circuit board 702 for the electrical connector 500 (shown in FIG. 5). The mating interface 700 includes a plurality of signal vias 702 for the signal contacts 502 (shown in FIG. 5) and a plurality of ground vias 704 for the ground contacts 504 (shown in FIG. 5). The vias 702, 704 are arranged in sets 706 that include a pair of signal vias 702 and one ground via 704. The ground vias 704 are positioned along a perpendicular bisector between the signal vias 702 and is thus positioned equidistant from each of the signal vias 702. The vias 702, 704 are arranged in three rows with the ground vias 704 in the middle row and the signal vias 702 in the outer rows. The signal vias 702 in adjacent sets 706 are oriented in an alternating inverted sequence.

The mating interface 700 includes a secondary mating area 708 having a plurality of vias 710 for receiving secondary contacts, which may be similar to the secondary contacts 194 (shown in FIG. 3). The vias 710 are arranged in four rows with the vias 710 in adjacent rows being staggered or offset to allow for denser spacing.

Figure 8:
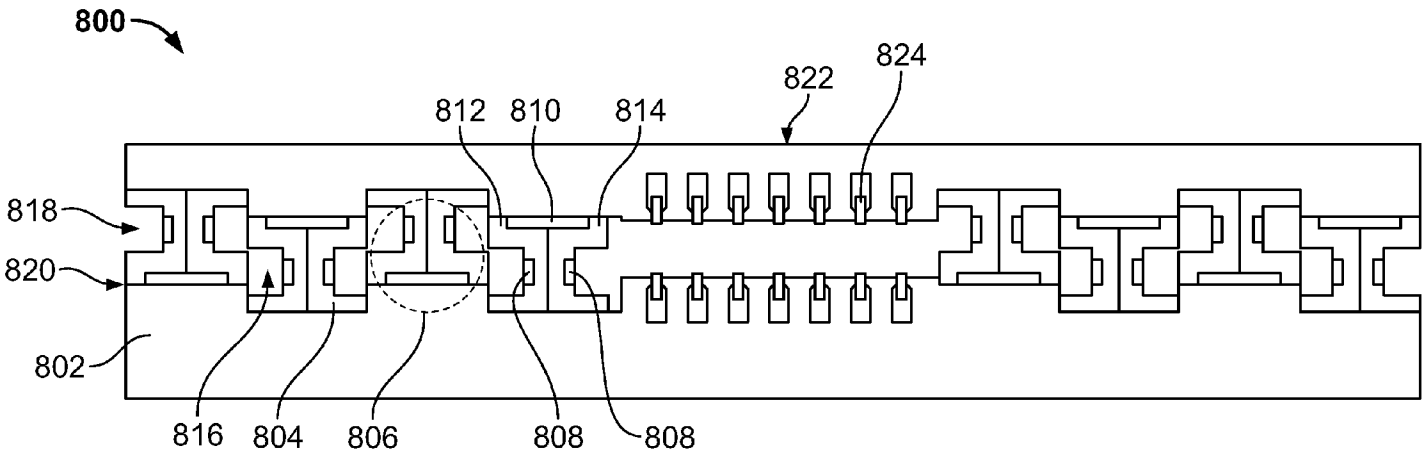
FIG. 8 is a cross-sectional view of yet another electrical connector.

FIG. 8 is a cross-sectional view of yet another electrical connector 800 including a housing 802 and a plurality of contact modules 804. The contact modules 804 may be similar to the contact modules 140 (shown in FIGS. 2 and 3). Each contact module 804 holds a contact set 806 that includes a pair of signal contacts 808 and a ground contact 810.

In the illustrated embodiment, each contact module 804 includes a first portion 812 and a second portion 814. The first and second portions 812, 814 are similarly formed and placed back to back to form the contact module 804. Optionally, the first and second portions 812, 814 may be coupled together, such as using a fastener, an adhesive, or other fastening means. Alternatively, the first and second portions 812, 814 may be held relative to one another within the housing 802 without being coupled to one another. The first portion 812 holds a first of the signal contacts 808 and the second portion 814 holds a second of the signal contacts 808. Both the first and second portions 812, 814 cooperate to hold the ground contact 810. The ground contact 810 is centered along the perpendicular bisector between the signal contacts 808. Both the first and second portions 812, 814 define channels 816 that expose the respective signal contact 808 to air.

The contact modules 804 are positioned in the housing 802 in an alternating inverted sequence. For example, adjacent contact modules 804 are rotated approximately 180 degrees with respect to one another. The ground contacts 810 of adjacent contact modules 804 are positioned in opposite sides of the contact modules 804 (e.g. on a top versus on a bottom of the contact modules 804). In an exemplary embodiment, the contact modules 804 are staggered within the housing 802 such that the contact modules 804 are positioned at different vertical heights from a bottom of the housing 802. As such, the signal contacts 808 are arranged in two rows, namely an upper row 818 and a lower row 820. Optionally, the contact modules may be oriented such that the ground contacts 810 are aligned within the rows 818, 820. For example, each ground contact 810 is substantially aligned in a common row with the signal contacts 808 of adjacent contact modules 804.

The electrical connector 800 includes a secondary mating area 822 having secondary contacts 824. The secondary mating area 822 includes a different mating interface and may include a different style of contact for mating with a plug connector. The signal and ground contacts 808, 810 and the secondary contacts 824 may be configured to terminate to a circuit board having either of the mating interfaces 200, 700 (shown in FIGS. 4 and 7, respectively), or alternatively, may be terminated to a circuit board having a completely different mating interface. When terminated to a circuit board having the mating interface 700, the signal and ground contacts 808, 810 may be transitioned by a transition section.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a housing having a mating end and a mounting end;

a plurality of contact modules, the contact modules extending between a mating end and a mounting end and the contact modules having a web with opposed contact faces and flanges extending from ends of the web, each contact module holding a pair of signal contacts with the signal contacts being arranged along the contact faces, the flanges and the web forming channels that expose the contact faces and signal contacts to air between the mating end and the mounting end; and a plurality of ground contacts, each ground contact being coupled to at least one of the housing and a corresponding contact module, each ground contact being arranged along one of the flanges of the corresponding contact module.

2. The electrical connector of claim 1, wherein the ground contact is arranged on the flange such that the center of the ground contact is positioned along a perpendicular bisector between signal contacts.

3. The electrical connector of claim 1, wherein the signal contacts are aligned with one another across the web and are arranged equidistant from the ground contact.

4. The electrical connector of claim 1, wherein the contact module has an I-shape.

5. The electrical connector of claim 1, wherein the signal contacts are substantially centered along the web between the flanges.

6. The electrical connector of claim 1, wherein the ground contact is substantially centered on the web, the ground contact has a width along the flange that extends beyond the signal contacts.

7. The electrical connector of claim 1, wherein the channel is open to air between the flanges.

8. The electrical connector of claim 1, wherein the contact modules are positioned within the housing such that the signal contacts of each contact module are aligned with one another in a row.

9. The electrical connector of claim 1, wherein the contact modules are positioned within the housing such that channels of adjacent contact modules are open to one another to form a chamber with signal contacts of different contact modules exposed within the chamber.

10. An electrical connector comprising:

a housing having a mating end and a mounting end;

a plurality of contact modules, the contact modules having a web with opposed contact faces and flanges extending from ends of the web, the contact modules holding a pair of signal contacts with the signal contacts being arranged along the contact faces, the flanges and the web forming channels that expose the contact faces and signal contacts, wherein the signal contacts are arranged along a contact axis, adjacent contacts being separated along the contact axis by different dielectrics; and a plurality of ground contacts, each ground contact being coupled to at least one of the housing and a corresponding contact module, each ground contact being arranged along one of the flanges of the corresponding contact module.

11. The electrical connector of claim 10, wherein the dielectric separating adjacent contacts within the pair have a first dielectric constant, the dielectric separating contacts of different pairs have a second dielectric constant different from the first dielectric constant.

12. The electrical connector of claim 1, wherein each ground contact is captured between the flange of the corresponding contact module and the housing.

13. An electrical connector comprising:

a housing having a mating end and a mounting end; and contact modules held by the housing, each contact module comprising:

a body having an I-shaped cross-section between a mating end and a mounting end, the I-shaped cross section being defined by a web and flanges at opposite ends of the web, the flanges and the web forming a first channel on one side of the web and a second channel on an opposite side of the web;

a pair of signal contacts held by the body along the web, the signal contacts being exposed in corresponding first and second channels; and a ground contact held by the body, the ground contact being arranged along one of the flanges.

14. The electrical connector of claim 13, wherein the body includes a 90 degree bend such that the I-shaped cross section at the mating end is generally perpendicular to the I-shaped cross-section at the mounting end.

15. The electrical connector of claim 13, wherein the first and second channels are filled with air to expose the signal contacts to air along a majority of signal propagation paths of the signal contacts through the contact module.

16. The electrical connector of claim 13, wherein the contact modules are held by housing end-to-end in a stacked configuration with the first and second channels of adjacent contact modules open to one another.

17. The electrical connector of claim 1, wherein the channels are filled with air to expose the signal contacts to air along a majority of signal propagation paths of the signal contacts through the contact module.

18. The electrical connector of claim 1, wherein the channels have a volume greater than a volume of the adjacent web.

19. The electrical connector of claim 1, wherein the contact modules are held by housing end-to-end in a stacked configuration with the first and second channels of adjacent contact modules open to one another.

20. The electrical connector of claim 1, wherein the contact modules each hold one pair of the signal contacts.

* * * * *